US007225477B1

(12) United States Patent
Rodriguez

(10) Patent No.: US 7,225,477 B1
(45) Date of Patent: Jun. 5, 2007

(54) FOOTBALL PAD SECURING DEVICE AND METHOD

(76) Inventor: Henry Rodriguez, 5614 Heleo Ave., Temple City, CA (US) 91780

( * ) Notice: Subject to any disclaimer, the term of this patent is extended or adjusted under 35 U.S.C. 154(b) by 193 days.

(21) Appl. No.: 11/150,768

(22) Filed: Jun. 13, 2005

(51) Int. Cl.
*A41D 27/26* (2006.01)

(52) U.S. Cl. ..... 2/461

(58) Field of Classification Search ..... 2/461, 2/460, 459, 462, 463, 467; 602/20
See application file for complete search history.

(56) References Cited

U.S. PATENT DOCUMENTS

| | | | | | |
|---|---|---|---|---|---|
| 3,307,872 | A | | 3/1967 | Murcott | |
| 3,740,762 | A | * | 6/1973 | Truelove | 2/462 |
| 4,292,687 | A | * | 10/1981 | Daverport, Jr. | 2/462 |
| 4,320,537 | A | * | 3/1982 | Mitchell | 2/462 |
| 4,938,535 | A | | 7/1990 | Condon et al. | |
| 5,038,984 | A | | 8/1991 | Izzo | |
| 5,056,869 | A | | 10/1991 | Morrison | |
| D328,186 | S | | 7/1992 | Hanke | |
| 5,159,715 | A | * | 11/1992 | Jurga et al. | 2/462 |
| 5,187,812 | A | | 2/1993 | Neuhalfon | |
| 5,215,333 | A | | 6/1993 | Knight | |
| 5,487,187 | A | * | 1/1996 | Zide et al. | 2/462 |
| 5,579,538 | A | * | 12/1996 | Brunty | 2/459 |
| 5,933,874 | A | * | 8/1999 | Randolph | 2/463 |
| 6,247,188 | B1 | | 6/2001 | Beland | |
| 6,971,123 | B2 | * | 12/2005 | Weaver | 2/468 |
| 2006/0053535 | A1 | * | 3/2006 | Ide et al. | 2/459 |

* cited by examiner

*Primary Examiner*—Rodney Lindsey

(57) ABSTRACT

A football pad securing device includes a pad assembly with a pair of shoulder pads each having a back covering and a chest covering. Elongated slots extend through each of the chest coverings. Each of a pair of loops is attached to one of the back coverings. Each of a pair of straps has a first end, a second end, a first side and a second side. Couplers are fixedly attached to the first ends. The couplers are removably securable to the slots. Each of a pair of hook and loop assemblies is attached to one of the straps and selectively attaches the first sides of the straps to themselves. The couplers are coupled to one of the slots and each of the second ends is extended through one of the loops. The hook and loop assemblies then secured the straps to the loops.

6 Claims, 5 Drawing Sheets

FOOTBALL PAD SECURING DEVICE AND METHOD

BACKGROUND OF THE INVENTION

1. Field of the Invention

The present invention relates to pad securing devices and more particularly pertains to a new pad securing device for securing a set of football pads to a torso of a football player.

2. Description of the Prior Art

The use of pad securing devices and, more generally, straps used for securing purposes is known in the prior art. U.S. Pat. No. 4,938,535 describes an adjustable seat belt adapted for securing a person within a vehicle. Another type securing device is U.S. Pat. No. 5,215,333 which includes a band again adapted for adjusting a seat belt. An adjustable strap used for holding and supporting a bag is found in U.S. Pat. No. Des. 328,186. Straps used for securing football shoulder pads is found in U.S. Pat. No. 5,187,812.

While these devices fulfill their respective, particular objectives and requirements, the need remains for a device that allows great flexibility when securing and tightening football pads to a player's torso. In particular, current systems include a buckle for adjusting the straps. However, the buckles must be unsecured from the pads in order to adjust them. For that reason, a new strap device and method is required for allowing a player to make quick adjustments to the fit of their shoulder pads.

SUMMARY OF THE INVENTION

The present invention meets the needs presented above by generally comprising a pad assembly that includes a pair of shoulder pads each having a back covering and a chest covering attached thereto. The chest coverings each have an elongated slot extending therethrough. Each of the slots is generally horizontally orientated. A pair of loops is provided. Each of the loops is attached to one of the back coverings. Each of a pair of straps has a first end, a second end, a first side and a second side. A pair of couplers is provided and each of the couplers is fixedly attached to one of the first ends of the straps. The couplers are removably extendable into one of the slots and releasably secure a corresponding one of the straps to the chest coverings. Each of a pair of hook and loop assemblies is attached to one of the straps and selectively attaches the first sides of the straps to themselves. The couplers are coupled to one of the slots and each of the second ends is extended through one of the loops so that first portions of the straps are defined between the couplers and the loops and second portions of the straps are defined between the loops and the second ends. Each of the straps is pulled to form a tight fit and the first portions are secured to the second portions with the hook and loop attaching assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
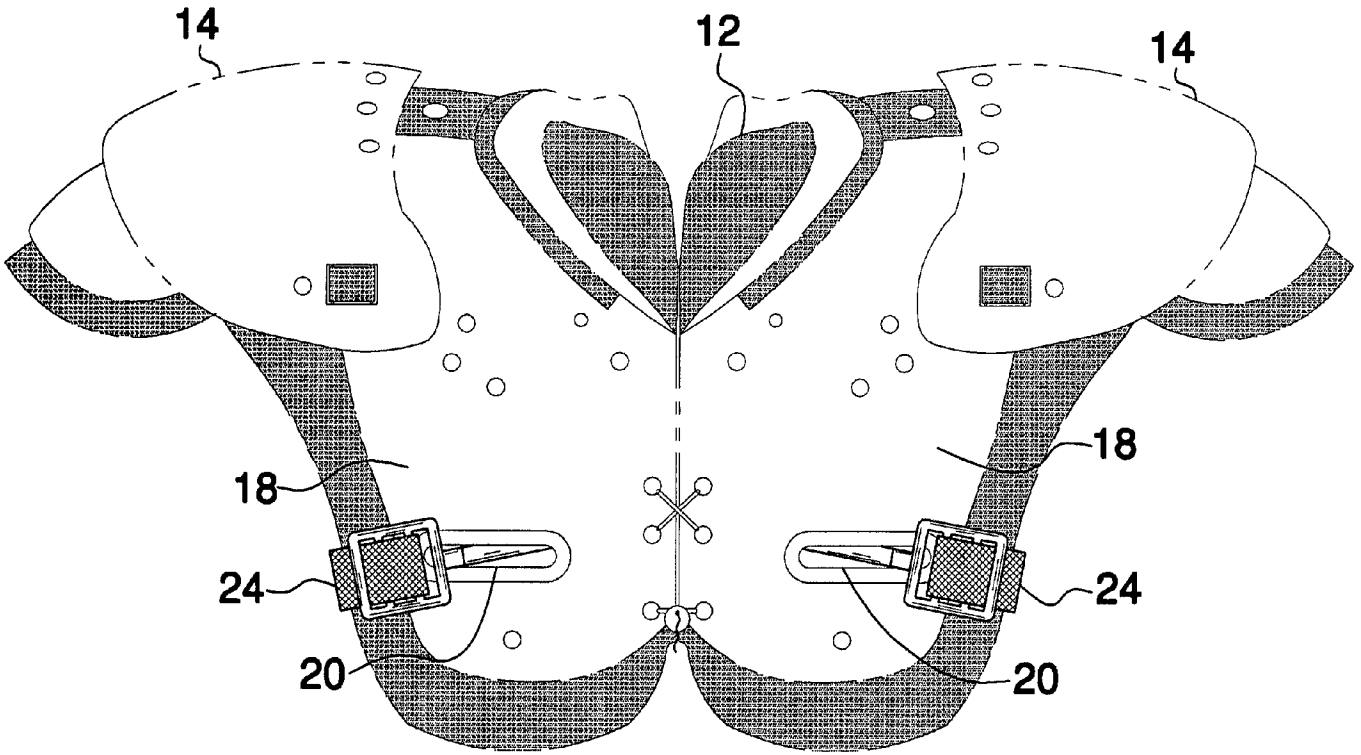
FIG. 1 is a front view of a football pad assembly and conventional tether device.

With reference now to the drawings, and in particular to FIGS. 1 through 5 thereof, a new pad securing device embodying the principles and concepts of the present invention and generally designated by the reference numeral 10 will be described.

Figure 2:
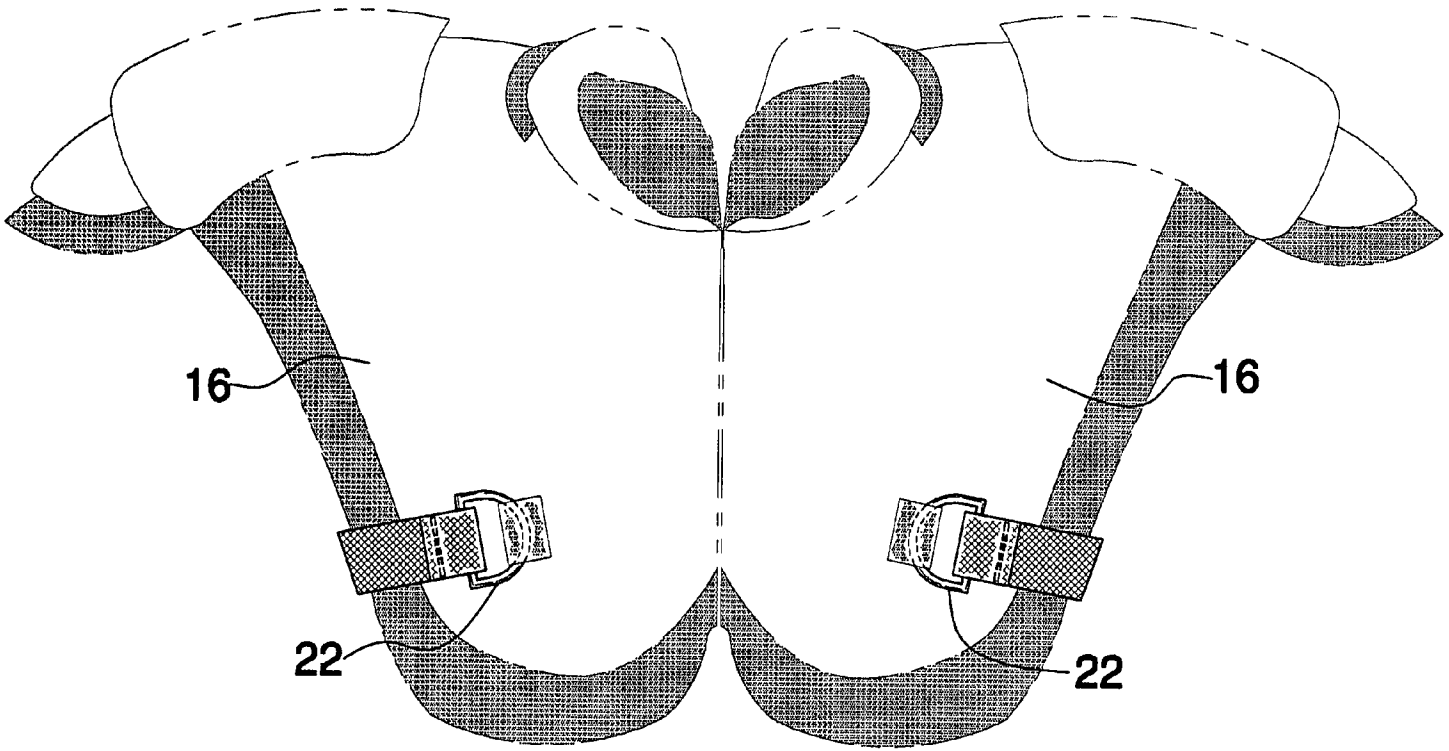
FIG. 2 is a rear view of a prior art football pad assembly and tether device.
Figure 3:
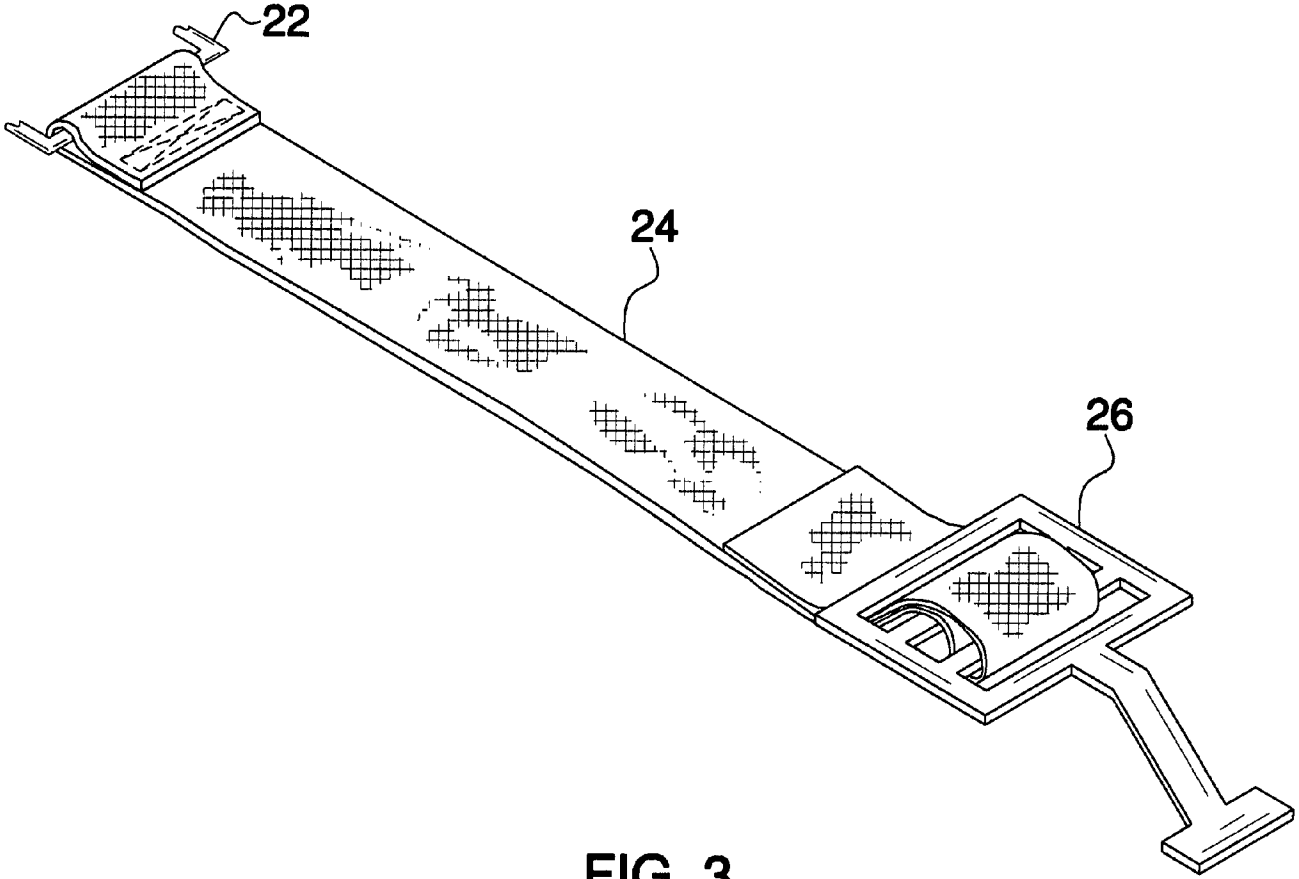
FIG. 3 is a perspective view of a tether according to the prior art.

As best illustrated in FIGS. 1 through 5, the football pad securing device and method 10 generally comprises providing pad assembly 12 that includes a pair of shoulder pads 14. Each of the shoulder pads 14 includes a back covering 16 and a chest covering 18 attached thereto. The chest coverings 18 each have an elongated slot 20 extending therethrough. Each of the slots 20 is generally horizontally orientated. A pair of loops 22 is provided. Each of the loops 22 is attached to one of the back coverings 16. The slots 20 and the loops 22 are each positioned distal with respect to the shoulder pads 14. The loops 22 each preferably comprise a D-ring. FIGS. 1 through 3 show a conventional shoulder pad and tether system where tethers 24 are fixedly attached to the loops 22 and adjustable buckles 26 attach the tethers 24 to the slots 20.

Figure 4:
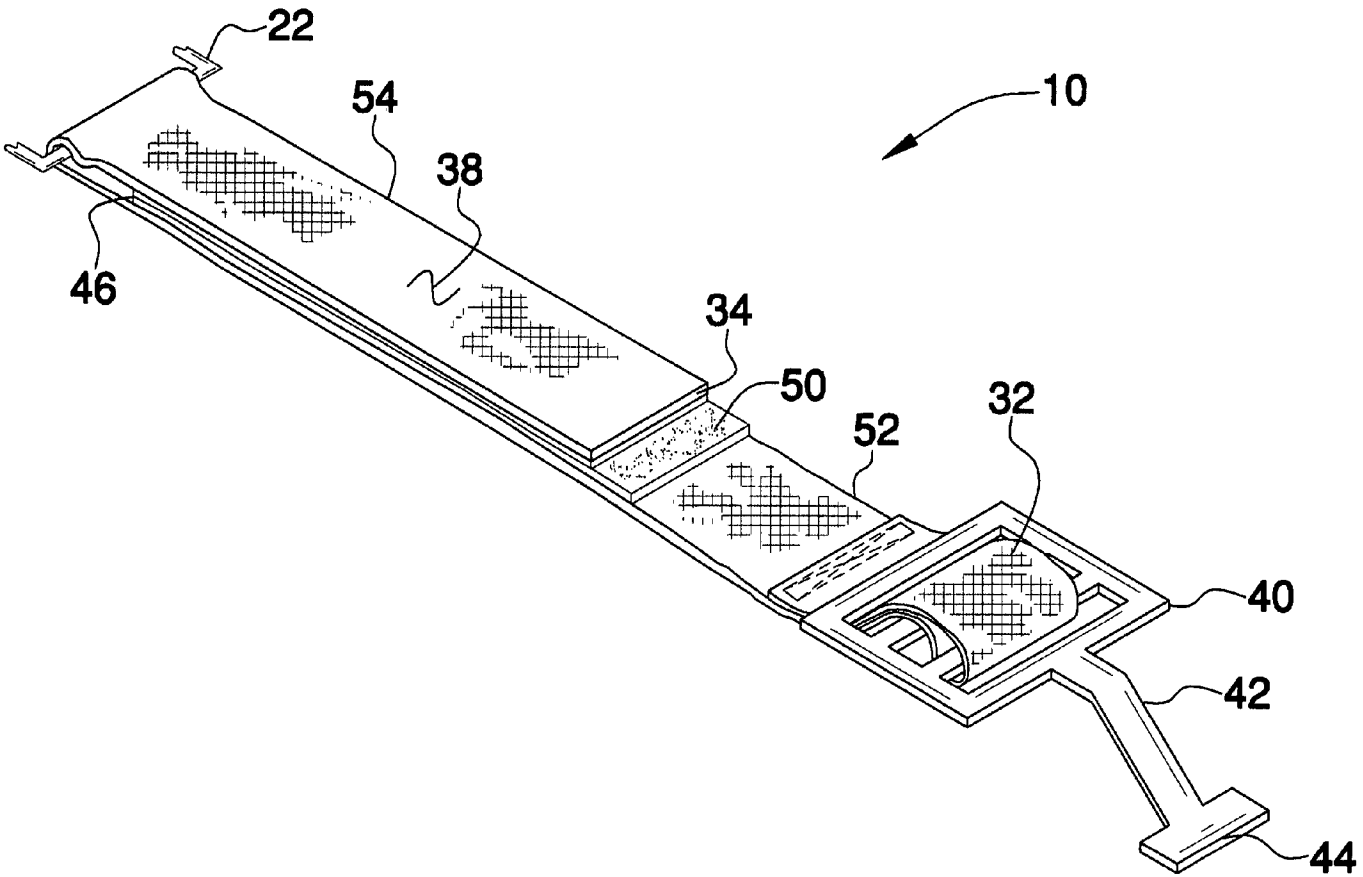
FIG. 4 is a perspective view of the present invention.
Figure 5:
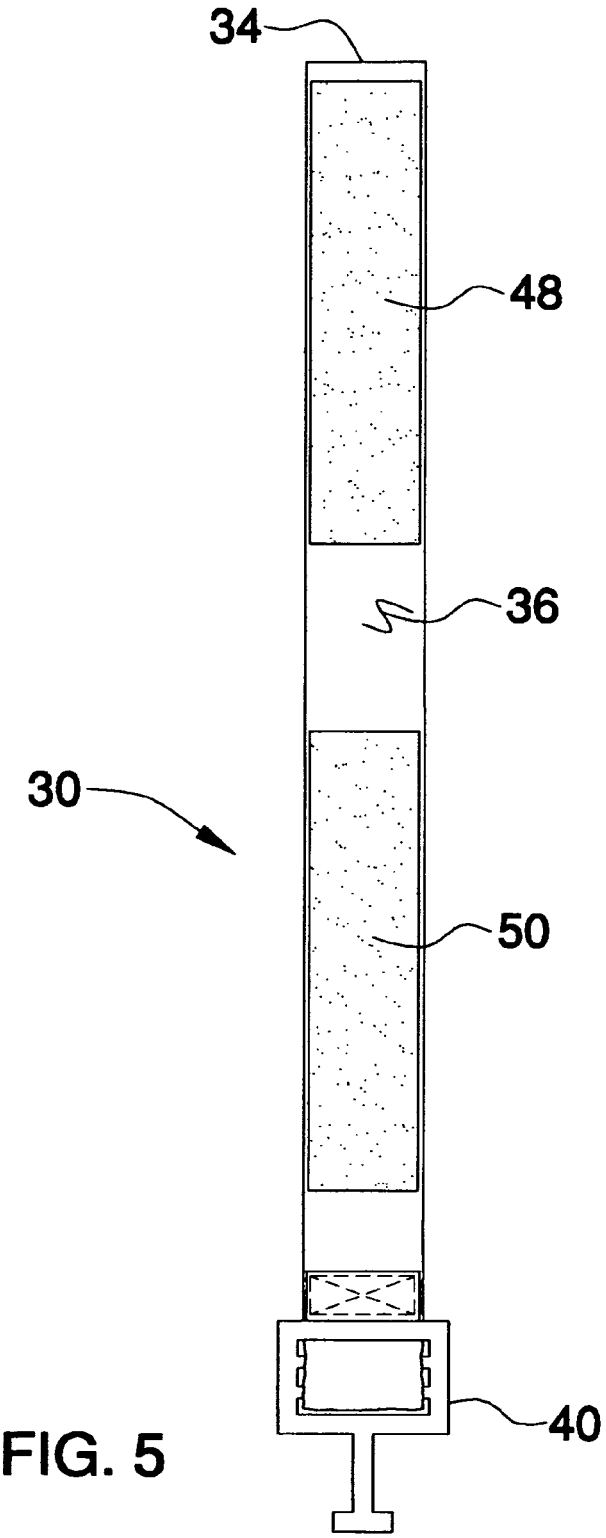
FIG. 5 is a top view of the present invention.

FIGS. 4 and 5 include a strap 30 that replaces the tethers 24 shown in FIGS. 1–3. The method 10 includes providing a pair of straps 30. Each of the straps 30 has a first end 32, a second end 34, a first side 36 and a second side 38. The straps 30 each have a length generally between 12 inches and 18 inches.

A pair of couplers 40 is provided. Each of the couplers 40 is fixedly attached to one of the first ends 32 of the straps 30. The couplers 40 are removably extendable into one of the slots 20 and releasably secure a corresponding one of the straps 30 to the chest coverings 18. The couplers 40 are conventional and include an angled post 42 having a free end having a plate 44 attached thereto. The post 42 is extended though one of the slots 20 and plate 44 rotated so that it prevents the post 42 from being removed from the slot 20.

A pair of hook and loop attaching assemblies 46 is provided. Each of the hook and loop assemblies 46 is attached to one of the straps 30 and selectively attaches the first sides 36 of the straps 30 to themselves. The hook and loop attaching assemblies 46 each includes a first attaching member 48 and a second attaching member 50. Each of the first 48 and second 50 attaching members is attached to one of the first sides 36 of the pair of straps 30. The first attaching members 48 are positioned adjacent to a respective one of the second ends 34 and extends toward the first ends 32 of the straps 30. Each of the second attaching members 50 is positioned between a corresponding one of the first attaching members 48 and the first ends 32 of the straps 30. The first attaching members 48 are each removably attachable to the corresponding one of the second attaching members 50.

In use, the pad assembly 12 is positioned on a person and each of the couplers 40 is coupled to one of the slots 20. Each of the second ends 34 of the straps 30 is extended through one of the loops 22 so that first portions 52 of the straps 30 are defined between the couplers 40 and the loops 22 and second portions 54 of the straps 30 are defined between the loops 22 and the second ends 34. The second ends 34 of the straps 30 are then pulled to form a tight fit. The first portions 52 are then secured to the second portions 54 with the hook and loop attaching assemblies 46. This allows for easy adjustment of the pad assembly 12 without the need of disconnecting the couplers 42, as is the case with the tethers 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of securing a set of shoulder pads, said method comprising the steps of:

providing a pad assembly including a pair of shoulder pads, each of said shoulder pads including a back covering and a chest covering attached thereto, each of said chest coverings having an elongated slot extending therethrough, each of said slots being generally horizontally orientated, a pair of loops being provided, each of said loops being attached to one of said back coverings;

providing a pair of straps, each of said straps having a first end, a second end, a first side and a second side;

providing a pair of couplers, each of said couplers being fixedly attached to one of said first ends of said straps, each of said couplers being removably extendable into one of said slots and releasably securing a corresponding one of said straps to said chest coverings;

providing a pair of hook and loop attaching assemblies, each of said hook and loop assemblies being attached to one of said straps and selectively attaching said first sides of said straps to themselves;

coupling each of said couplers to one of said slots;

extending each of said second ends through one of said loops such that first portions of said straps are defined between said couplers and said loops and second portions of said straps are defined between said loops and said second ends; and pulling each of said straps to form a tight fit and securing said first portions to said second portions with said hook and loop attaching assemblies.

2. The method according to claim 1, wherein each of said slots and said loops are positioned distal with respect to said shoulder pads.

3. The method according to claim 1, wherein each of said loops comprises a D-ring.

4. The method according to claim 1, wherein each of said straps has a length generally between 12 inches and 18 inches.

5. The method according to claim 1, wherein said hook and loop attaching assemblies each includes a first attaching member and a second attaching member each being attached to one of said first sides of said pair of straps, said first attaching members being positioned adjacent to a respective one of said second ends and extending toward said first ends, each of said second attaching members being positioned between a corresponding one of said first attaching members and said first ends of said straps, each of said first attaching members being removably attachable to the corresponding one of said second attaching members.

6. A method of securing a set of shoulder pads comprising the steps of:

providing a pad assembly including a pair of shoulder pads, each of said shoulder pads including a back covering and a chest covering attached thereto, each of said chest coverings having an elongated slot extending therethrough, each of said slots being generally horizontally orientated, a pair of loops being provided, each of said loops being attached to one of said back coverings, each of said slots and said loops being positioned distal with respect to said shoulder pads, each of said loops comprising a D-ring;

providing a pair of straps, each of said straps having a first end, a second end, a first side and a second side, each of said straps having a length generally between 12 inches and 18 inches;

providing a pair of couplers, each of said couplers being fixedly attached to one of said first ends of said straps, each of said couplers being removably extendable into one of said slots and releasably securing a corresponding one of said straps to said chest coverings;

providing a pair of hook and loop attaching assemblies, each of said hook and loop assemblies being attached to one of said straps and selectively attaching said first sides of said straps to themselves, said hook and loop attaching assemblies each including a first attaching member and a second attaching member each being attached to one of said first sides of said pair of straps, said first attaching members being positioned adjacent to a respective one of said second ends and extending toward said first ends, each of said second attaching members being positioned between a corresponding one of said first attaching members and said first ends of said straps, each of said first attaching members being removably attachable to the corresponding one of said second attaching members;

coupling each of said couplers to one of said slots;

extending each of said second ends through one of said loops such that first portions of said straps are defined between said couplers and said loops and second portions of said straps are defined between said loops and said second ends; and pulling each of said straps to form a tight fit and securing said first portions to said second portions with said hook and loop attaching assemblies.

* * * * *